US006609929B2

(12) United States Patent
Kamarauskas et al.

(10) Patent No.: US 6,609,929 B2
(45) Date of Patent: Aug. 26, 2003

(54) ELECTRICAL CONNECTOR ASSEMBLY

(75) Inventors: Michael R. Kamarauskas, Bloomingdale, IL (US); Raymond Froude, Bartlett, IL (US); Yan Margulis, Buffalo Grove, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/051,572

(22) Filed: Jan. 18, 2002

(65) Prior Publication Data

US 2003/0139091 A1 Jul. 24, 2003

(51) Int. Cl.[7] ..... H01R 13/60

(52) U.S. Cl. ..... 439/541.5; 439/676; 439/701; 439/717; 439/540.1

(58) Field of Search ..... 439/717, 676, 439/701, 541.5, 594, 540.1

(56) References Cited

U.S. PATENT DOCUMENTS

| | | | | | |
|---|---|---|---|---|---|
| 4,501,464 | A | | 2/1985 | Bogese, II | 339/176 |
| 4,577,921 | A | | 3/1986 | Bogese, II | 339/176 |
| 4,797,123 | A | | 1/1989 | Weber | 439/717 |
| 5,288,250 | A | | 2/1994 | Sumida | 439/701 |
| 5,385,490 | A | * | 1/1995 | Demeter et al. | 439/579 |
| 5,431,586 | A | | 7/1995 | Klas et al. | 439/676 |
| 5,531,612 | A | | 7/1996 | Goodall et al. | 439/541.5 |
| 5,639,267 | A | | 6/1997 | Loudermilk | 439/701 |
| 5,697,817 | A | | 12/1997 | Bouchan et al. | 439/676 |
| 5,879,199 | A | | 3/1999 | Belopolsky | 439/701 |
| 5,893,778 | A | | 4/1999 | Mansutti | 439/701 |
| 5,895,296 | A | | 4/1999 | Okabe | 439/701 |
| 5,961,350 | A | | 10/1999 | Shiu | 439/607 |
| 6,019,631 | A | * | 2/2000 | Chen | 439/541.5 |
| 6,080,011 | A | | 6/2000 | Tsao et al. | 439/541.5 |
| 6,179,650 | B1 | * | 1/2001 | Chih-Kai | 439/540.1 |
| 6,206,725 | B1 | | 3/2001 | Wu | 439/541.5 |
| 6,210,214 | B1 | | 4/2001 | Chang | 439/541.5 |
| 6,210,237 | B1 | | 4/2001 | Chang | 439/676 |
| 6,227,911 | B1 | | 5/2001 | Boutros et al. | 439/620 |
| 6,280,245 | B1 | * | 8/2001 | Han | 439/541.5 |

FOREIGN PATENT DOCUMENTS

| | | | | |
|---|---|---|---|---|
| FR | 2 622 742 A1 | * | 5/1989 | 439/541.5 |

* cited by examiner

*Primary Examiner*—Tho D. Ta
(74) *Attorney, Agent, or Firm*—Stephen Z. Weiss

(57) ABSTRACT

An electrical connector assembly includes a pair of modular subassemblies each having an outer housing with a mating face defining a mating portion for mating with a complementary connector in a mating direction. The outer housing also has a side face with a cavity. A terminal module includes a dielectric inner housing positioned in the cavity. A plurality of terminals are mounted on the inner housing, with contact portions at the mating portion for engaging appropriate contacts of the complementary mating connector. Therefore, the outer housings of the modular subassemblies can be joined at the side faces thereof to conceal the terminal modules therewithin.

39 Claims, 3 Drawing Sheets

ELECTRICAL CONNECTOR ASSEMBLY

FIELD OF THE INVENTION

This invention generally relates to the art of electrical connectors and, particularly, to an electrical connector assembly such as a modular jack assembly.

BACKGROUND OF THE INVENTION

A typical electrical connector assembly includes some form of dielectric housing which may or may not be surrounded by a protective metal shield, with a plurality of conductive terminals mounted on or in the housing. For instance, the housing typically is configured to include a receptacle or female portion or a plug or male portion for mating with a complementary connector of an opposite configuration. The housing also may be configured for mounting on a printed circuit board so that the terminals of the connector can be electrically connected to circuit traces on the printed circuit board. Still further, it has become expedient to provide the terminals as components of a terminal module which may include an inner housing on which the terminals are mounted, and this terminal module is assembled into the outer housing. Such modules provide for efficient manufacture and assembly of such connectors. For instance, the terminals may be overmolded in the inner housing, and this singular subassembly or module is assembled within the larger outer housing of the connector assembly.

An example of such electrical connectors as described above is a modular jack assembly which is used extensively in the telecommunications industry. A typical modular jack-type connector includes a plurality of spring beam-type terminals which protrude from a portion of the jack housing into a jack plug-receiving cavity of the housing. The terminals or contact portions of the terminals usually are separated from each other by molded portions of the housing. The fabrication and assembly of such modular jack connectors has become increasingly difficult and complicated due to the ever-increasing miniaturization and density of such connector arrangements. Further complicating these problems is that, in order to reduce the cost and space requirements of many applications, plural modular jacks have been integrated in a single housing in a juxtaposed arrangement. The housing, in turn, typically is mounted on a printed circuit board, particularly when associated with the transmission of digital data in computing equipment, for instance. Still further, it may be desirable to mount a multi-receptacle modular jack assembly onto a printed circuit board, such that the jack plugs can be inserted from the top of the assembly housing toward the circuit board. All of these desirable arrangements, in combination with the continuing miniaturization of the connectors, makes it very difficult, if at all possible, to use the efficient terminal module system in such connectors. The present invention is directed to solving this myriad of problems by providing an electrical connector assembly, such as a modular jack assembly, which makes efficient use of terminal modules separate from the overall connector housing means.

SUMMARY OF THE INVENTION

An object, therefore, of the invention is to provide a new and improved electrical connector assembly, such as a modular jack assembly, of the character described.

Another object of the invention is to provide a new and improved electrical connector or modular jack assembly for mounting on a printed circuit board and incorporating plural jack receptacles.

In the exemplary embodiment of the invention, a modular jack assembly is provided for mounting on a printed circuit board. The assembly includes a pair of complementary interengageable modular subassemblies. Each subassembly includes an outer housing having a top face with at least one receptacle for receiving an appropriate mating jack plug in a plug insertion direction, along with a side face with a cavity and passages communicating with the receptacle. A terminal module includes a dielectric inner housing positioned in the cavity in the side face of the outer housing in a direction transversely of the plug insertion direction. A plurality of terminals are mounted on the inner housing, with contact portions of the terminals projecting through the passages into the receptacle for engaging appropriate contacts of the mating jack plug. Therefore, the outer housings of the modular subassemblies can be joined at the side faces thereof complete jack assembly, concealing the terminal modules therewithin.

The outer housings of the pair of modular subassemblies may include complementary interengaging latch means at the side faces of the outer housings to hold the subassemblies together. As disclosed herein, the latch means include at least one latch arm on the outer housing of at least one of the modular subassemblies engageable with a latch member on the outer housing of the other modular subassembly. In the preferred embodiment, the outer housings of the pair of modular subassemblies are hermaphroditic, with one of the latch arms and one of the latch members on each outer housing.

Complementary interengaging locating means may be provided between the outer housings of the pair of modular subassemblies. As disclosed herein, the locating means include at least one locating post projecting from the side face of the outer housing of at least one of the modular subassemblies insertable into a locating hole in the side face of the outer housing of the other modular subassembly generally perpendicular to the plug insertion direction. In the preferred embodiment, the outer housings of the pair of modular subassemblies are hermaphroditic, with one of the locating posts and one of the locating holes on each outer housing. The locating post and locating hole of each outer housing are immediately adjacent each other and are shown herein as being semi-cylindrical in cross-section.

Other features of the invention include complementary interengaging retention means between the outer and inner housings of each modular subassembly for retaining the terminal module on the outer housing, with the inner housing in the cavity of the outer housing. The terminating portions of the terminals may comprise tail portions for insertion into appropriate holes in the printed circuit board. The contact portions of the terminals comprise arm portions cantilevered into the respective receptacle generally parallel to the plug insertion direction. Finally, in the disclosed embodiment, the top face of the outer housing of each modular subassembly includes a plurality of the receptacles, along with a plurality of terminal modules insertable into a corresponding plurality of cavities in the side face of the housing of the respective modular subassembly.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims.

The invention, together with its objects and the advantages thereof, may be best understood by reference to the following description taken in conjunction with the accompanying drawings, in which like reference numerals identify like elements in the figures and in which.

DETAILED DESCRIPTION OF THE PREFERRED EMBODIMENT

Figure 1:
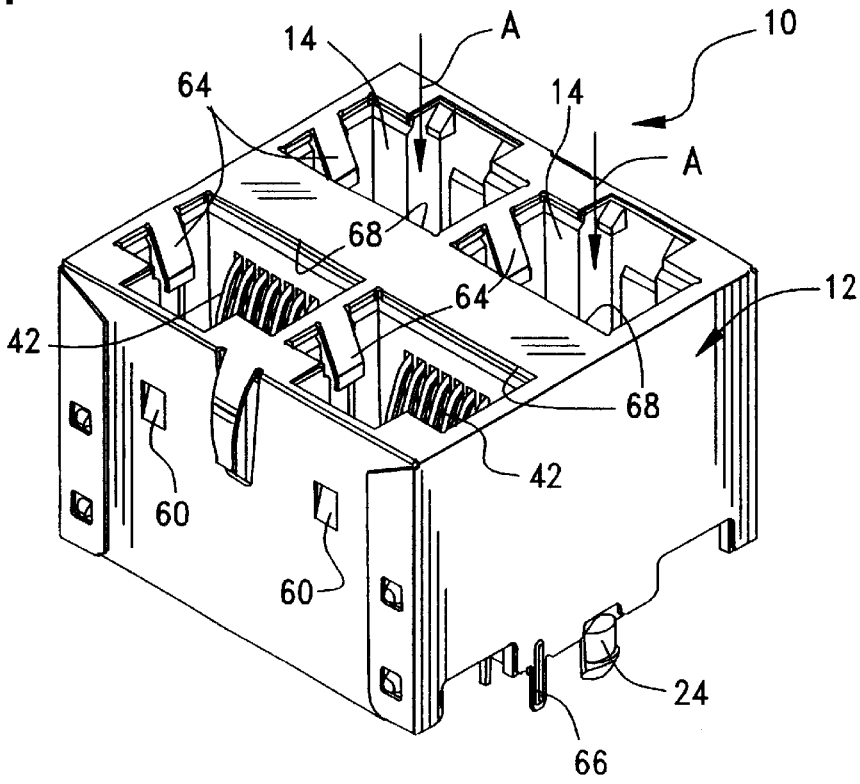
FIG. 1 is a top perspective view of an electrical connector assembly in the form of a "multi-port" modular jack assembly incorporating the concepts of the invention.

Referring to the drawings in greater detail, the invention is embodied in an electrical connector assembly in the form of a modular jack assembly, generally designated 10 in FIG. 1. The assembly includes an outer shield, generally designated 12, which is stamped and formed of sheet metal material to provide EMI and RFI protection for the assembly. The assembly is a "multi-port" modular jack in that it includes a plurality of ports or receptacles 14 for receiving a plurality of modular jack plugs in insertion directions indicated by arrows "A". In other words, the jack plugs comprise complementary mating connectors and, as is known in the art, the plugs have appropriate electrical contacts or terminals.

Figure 2:
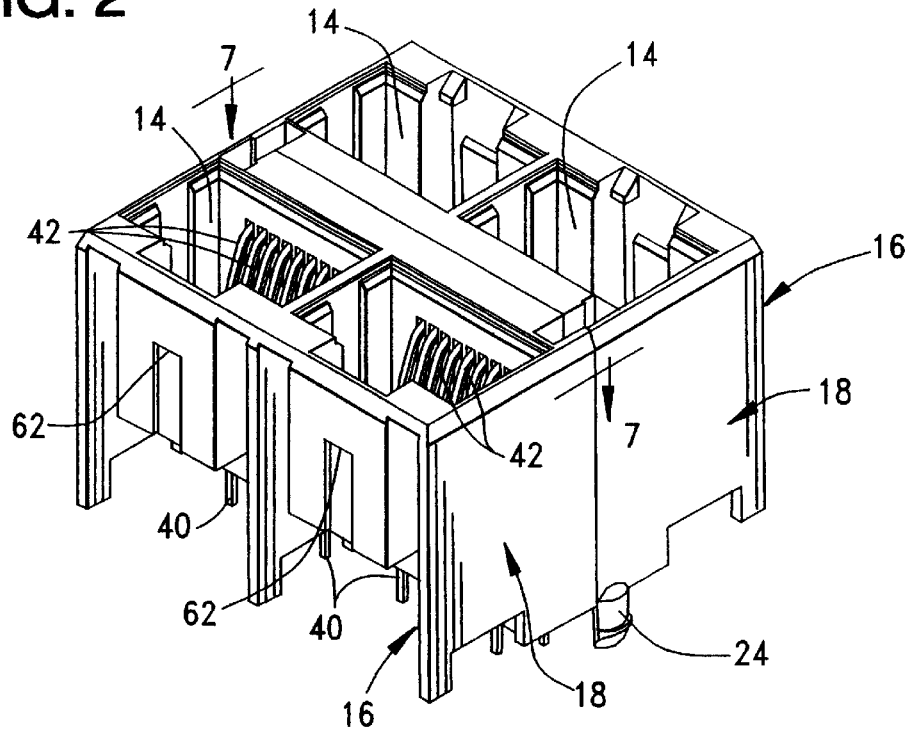
FIG. 2 is a top perspective view of the modular jack assembly, with the outer shield removed.
Figure 3:
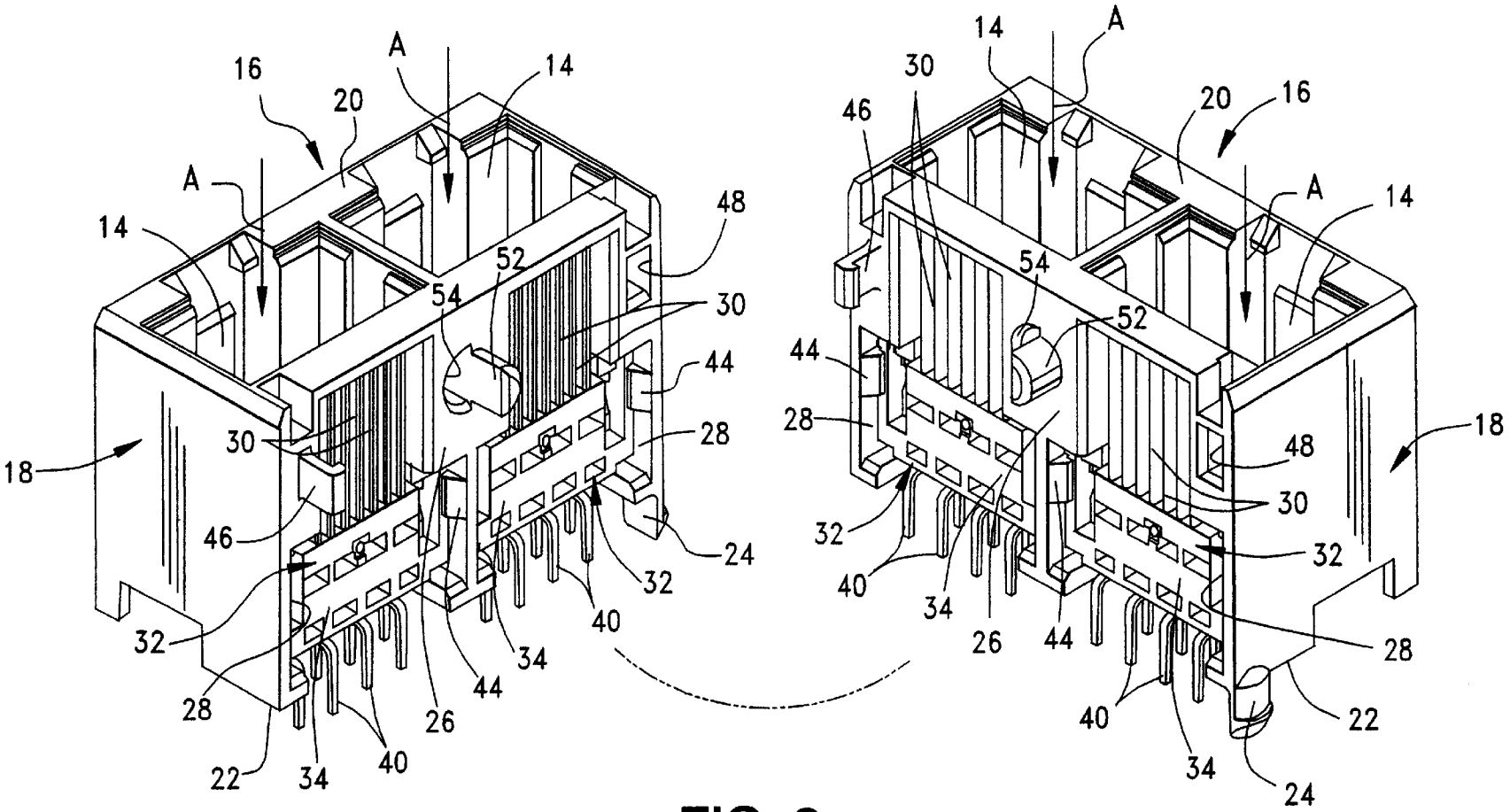
FIG. 3 is a top perspective view of the pair of modular subassemblies separated from the condition of FIG. 2.
Figure 4:
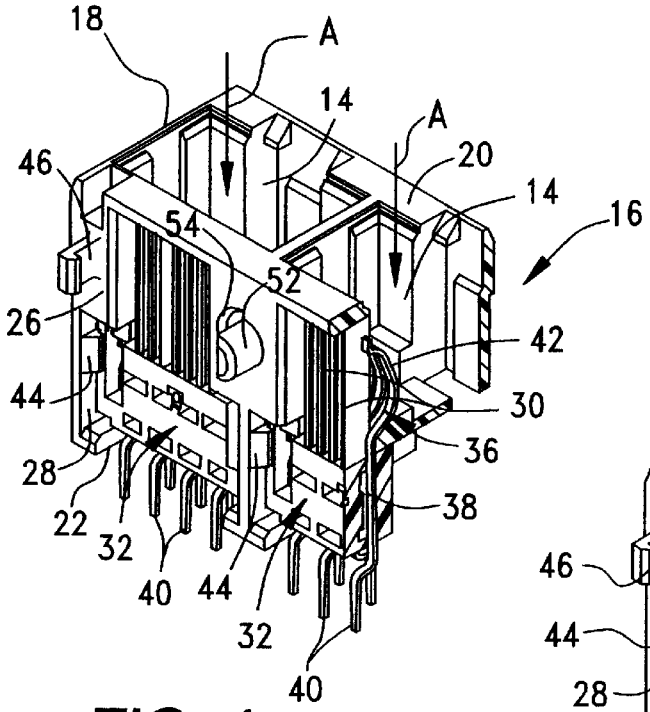
FIG. 4 is a bottom perspective view, partially in section, of one of the modular subassemblies.
Figure 5:
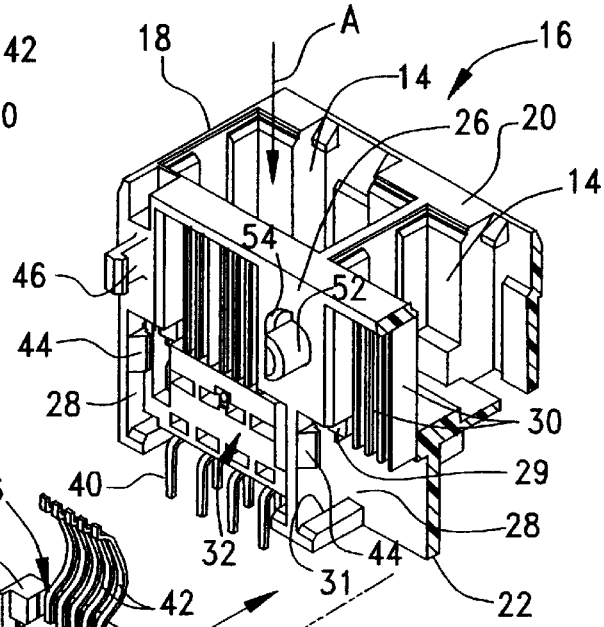
FIG. 5 is a view similar to that of FIG. 4, with one of the terminal modules removed.

Modular jack assembly 10 includes a pair of complementary interengageable modular subassemblies, generally designated 16 in FIGS. 2–5. FIG. 2 shows the pair of modular subassemblies interengaged whereby they can be surrounded by shield 12 as seen in FIG. 1. FIG. 3 shows the pair of modular subassemblies separated from the interengaged condition of FIG. 2. FIGS. 4 and 5 show an individual one of the modular subassemblies 16. At this point, it should be noted that each modular subassembly 16 is hermaphroditic. In other words, they are similar or identical in structure and configuration. Therefore, only one modular subassembly will be described immediately below in relation to FIGS. 3–5.

In particular, each modular subassembly 16 includes an outer housing, generally designated 18, which may be molded of dielectric material such as plastic or the like. The outer housing of each modular subassembly has a top face 20 with a pair of "ports" or receptacles 14 whereby, when two of the modular subassemblies are interengaged as shown in FIG. 2, the assembly includes four receptacles to form a four-port final connector assembly 10 as seen in FIG. 1.

Referring back to FIGS. 3–5, outer housing 18 of each modular subassembly 16 also includes a bottom face 22 for mounting on a printed circuit board (not shown). The housing may include one or more mounting posts 24 for insertion into appropriate mounting holes in the circuit board. The housing includes a side face 26 which has a pair of cavities 28 along with a plurality of slots or passages 30 which communicate with receptacles 14. In other words, side face 26 is substantially open because of the existence of cavities 28 and passages 30.

Each modular subassembly 16 includes a pair of terminal modules, generally designated 32 (FIGS. 3–6). Each terminal module 32 includes a dielectric inner housing 34 which may be molded of plastic material or the like. A plurality of terminals, generally designated 36 (FIGS. 4 and 5), are mounted in each inner housing 34. In the preferred embodiment, the respective inner housing 34 is overmolded about body portions 38 of the terminals. Each terminal includes a tail portion 40 projecting from bottom face 22 of outer housing 18 for insertion into appropriate holes in the printed circuit board and for connection, as by soldering, to circuit traces on the board and/or in the holes. As best seen in FIG. 4, terminals 36 have contact portions or arms 42 which are cantilevered into the respective receptacle 14 generally parallel to plug-insertion direction "A".

In assembly, a pair of the terminal modules 32 are assembled into outer housing 18 of each modular subassembly 16 by inserting the terminal modules in the direction of arrow "B" (FIG. 5). During insertion, inner housings 34 of the terminal modules are inserted into cavities 28 through side face 26 of the outer housing. Once inserted, the upper edge 33 and the lower edge 35 of the inner housing 34 will engage the upper shoulder 29 and lower shoulder 31 respectively of the cavity 28 preventing relative movement between the inner and outer housings in the direction of arrow "A". Cantilevered contact arms 42 move through passages or slots 30 in side face 20 and into position within the respective receptacles 14 as seen in FIG. 4. Once fully inserted, inner housings 34 of terminal modules 32 snap behind retention means in the form of a pair of retention bosses 44 within opposite sides of cavities 28. This can be seen clearly in FIGS. 3–5.

Figure 7:
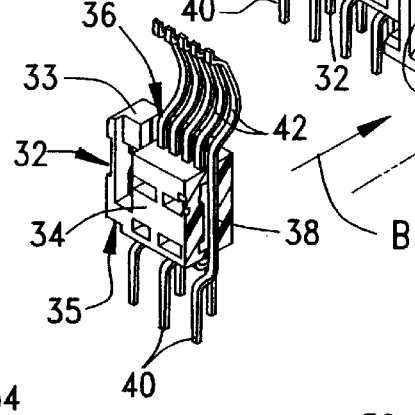
FIG. 7 is an enlarged, fragmented section taken generally along line 7—7 in FIG. 2
Figure 7:
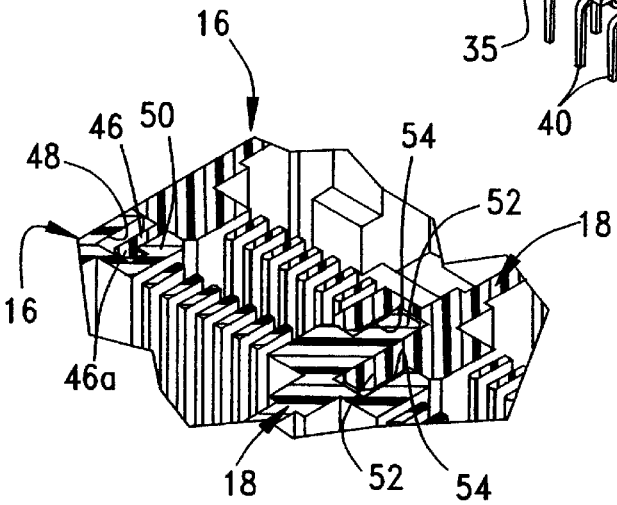
Figure 6:
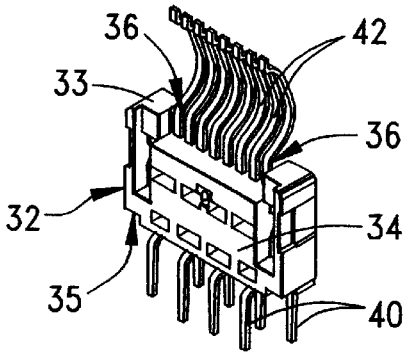
FIG. 6 is a perspective view of one of the terminal modules.

Generally, complementary interengaging latch means are provided between outer housings 18 of the pair of modular subassemblies 16 for holding the subassemblies together with their side faces juxtaposed as seen in FIG. 2. More particularly, as seen in FIGS. 3–5, a hooked latch arm 46 projects outwardly from side face 26 of outer housing 18 of each modular subassembly 16. In addition, as seen in FIG. 3, a latch hole 48 also is formed in the side face of the outer housing. Keeping in mind that the outer housings of the two modular subassemblies are hermaphroditic, one of the latch arms 46 and one of the latch holes 48 are provided on each outer housing. FIG. 7 shows one of the hooked latch arms 46 inserted into one of the latch holes 48 when the modular subassemblies are interengaged. A latch shoulder 50 is defined within each latch hole 48 for latchingly engaging a hook portion 46*a* of latch arm 46. Of course, when the outer housings of the two modular subassemblies are fully interengaged; two of the latch arms are interengaged at opposite sides of the assembly.

Generally, complementary interengaging locating means are provided between outer housings 18 of modular subassemblies 16 for facilitating locating the housings during assembly. More particularly, FIGS. 3–5 show a locating post 52 immediately adjacent a locating hole 54 at the center of side face 26 of the outer housing of each modular subassembly 16. It can be seen that the locating post and the locating hole each are semi-cylindrical in cross-section. Again, keeping in mind that outer housings 18 of the modular subassemblies are hermaphroditic, the semi-cylindrical locating post of the outer housing of one modular subassembly is inserted into the locating hole in the outer housing of the other modular subassembly when the pair of subassemblies are interengaged as shown in FIG. 2. FIG. 7 specifically shows how locating posts 52 interengage within locating holes 54 when the subassemblies are interengaged.

Finally, after a pair of the terminal modules 32 are assembled within the outer housing of each modular subassembly 16 as described above, and after the pair of modular subassemblies are interengaged as shown in FIG. 2, protective metal shield 12 is added to the assembly as seen in FIG. 1. The metal shield has a plurality of stamped and formed locking tabs 60 (FIG. 1) which lockingly interengage behind a plurality of locking shoulders 62 (FIG. 2) formed on the outsides of the outer housings of modular subassemblies 16. A plurality of grounding tabs 64 (FIG. 1) are formed integral with the shield and project into receptacles 14 for engaging appropriate ground means or ground shields of the complementary mating jack plugs. The shield also has a plurality of legs 66 depending from the bottom thereof for insertion into appropriate holes in the printed circuit board and for connection to appropriate ground circuit means on the board. The top of the shield has four ports 68 in registry with receptacles 14.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A modular jack assembly for mounting on a printed circuit board, comprising:

a pair of complementary interengageable modular subassemblies each including an outer housing having a top face with at least one receptacle for receiving an appropriate mating jack plug in a plug insertion direction, a bottom face for mounting on the printed circuit board, and a side face passages communicating with said receptacle and a cavity;

a terminal module having a dielectric inner housing positioned in said cavity in the side face of the outer housing in a direction transversely of said plug insertion direction, and a plurality of terminals mounted on the inner housing with contact portions of the terminals projecting through said passages into the receptacle for engaging appropriate contacts of the mating jack plug and terminating portions of the terminals exposed at the bottom face of the outer housing for engaging appropriate circuit means on the printed circuit board; and complementary interengaging latch means between the outer housings of the pair of modular subassemblies for holding the subassemblies together with said side faces thereof juxtaposed.

2. The modular jack assembly of claim 1, including complementary interengaging retention means between the outer and inner housings of each modular subassembly for retaining the terminal module on the outer housing with the inner housing in the cavity of the outer housing.

3. The modular jack assembly of claim 1 wherein the top face of the outer housing of at least one of the modular subassemblies includes a plurality of said receptacles, along with a corresponding plurality of said terminal modules in plural cavities in the side face of the outer housing of the at least one modular subassembly.

4. The modular jack assembly of claim 1 wherein the outer housing of each modular subassembly includes a plurality of receptacles in the top face thereof and a plurality of cavities in the side face thereof, along with a corresponding plurality of said terminal modules in said cavities.

5. The modular jack assembly of claim 1 wherein the terminating portions of said terminals comprise tail portions for insertion into appropriate holes in the printed circuit board.

6. The modular jack assembly of claim 1 wherein said complementary interengaging latch means include at least one latch arm on the outer housing of at least one of the modular subassemblies engageable with a latch member on the outer housing of the other subassembly.

7. The modular jack assembly of claim 6 wherein the outer housings of said pair of modular subassemblies are hermaphroditic, with one of said latch arms and one of said latch members on each outer housing.

8. The modular jack assembly of claim 1, including complementary interengaging locating means between the outer housings of said pair of modular subassemblies.

9. The modular jack assembly of claim 4 wherein said complementary interengaging locating means include at least one locating post projecting from the side face of the outer housing of at least one of the modular subassemblies insertable into a locating hole in the side face of the outer housing of the other subassembly generally perpendicular to said plug insertion direction.

10. The modular jack assembly of claim 9 wherein the outer housings of said pair of modular subassemblies are hermaphroditic, with one of said locating posts and one of said locating holes on each outer housing.

11. The modular jack assembly of claim 10 wherein the locating post and locating hole of each outer housing are immediately adjacent each other and are semi-cylindrical in cross-section.

12. The modular jack assembly of claim 1 wherein the contact portions of said terminals comprise arm portions cantilevered into the respective receptacle generally parallel to the plug insertion direction.

13. The modular jack assembly of claim 12 wherein the terminating portions of said terminals comprise tail portions for insertion into appropriate holes in the printed circuit board.

14. A modular jack assembly, comprising:

a pair of complementary modular subassemblies each including an outer housing having a top face with at least one receptacle for receiving an appropriate mating jack plug in a plug insertion direction, and a side face with passages communicating with the receptacle and a cavity; and a terminal module having a dielectric inner housing positioned in said cavity in the side face of the outer housing in a direction transversely of said plug insertion direction, and a plurality of terminals mounted on the inner housing with contact portions projecting through said passages into the receptacle for engaging appropriate contacts of the mating jack plug;

whereby the outer housings of the modular subassemblies can be joined at the side faces thereof concealing the terminal modules therewithin.

15. The modular jack assembly of claim 14 wherein said cavity includes upper and lower shoulders which engage upper and lower edges respectively of the inner housing.

16. The modular jack assembly of claim 14, including complementary interengaging retention means between the outer and inner housings of each modular subassembly for retaining the terminal module on the outer housing with the inner housing in the cavity of the outer housing.

17. The modular jack assembly of claim 14 wherein the top face of the outer housing of at least one of the modular subassemblies includes a plurality of said receptacles, along with a corresponding plurality of said terminal modules in plural cavities in the side face of the outer housing of the at least one modular subassembly.

18. The modular jack assembly of claim 14 wherein the outer housing of each modular subassembly includes a plurality of receptacles in the top face thereof and a plurality of cavities in the side face thereof, along with a corresponding plurality of terminal modules in said cavities.

19. The modular jack assembly of claim 14 wherein the contact portions of said terminals comprise arm portions cantilevered into the respective receptacle generally parallel to the plug insertion direction.

20. The modular jack assembly of claim 14, including complementary interengaging latch means between the outer housings of the pair of modular subassemblies at the side faces of the outer housings to hold the subassemblies together.

21. The modular jack assembly of claim 20 wherein said complementary interengaging latch means include at least one latch arm on the outer housing of at least one of the modular subassemblies engageable with a latch member on the outer housing of the other subassembly.

22. The modular jack assembly of claim 21 wherein the outer housings of said pair of modular subassemblies are hermaphroditic, with one of said latch arms and one of said latch members on each outer housing.

23. The modular jack assembly of claim 14, including complementary interengaging locating means between the outer housings of said pair of modular subassemblies.

24. The modular jack assembly of claim 23 wherein said complementary interengaging locating means include at least one locating post projecting from the side face of the outer housing of at least one of the modular subassemblies insertable into a locating hole in the side face of the outer housing of the other subassembly generally perpendicular to said plug insertion direction.

25. The modular jack assembly of claim 24 wherein the outer housings of said pair of modular subassemblies are hermaphroditic, with one of said locating posts and one of said locating holes on each outer housing.

26. The modular jack assembly of claim 25 wherein the locating post and locating hole of each outer housing are immediately adjacent each other and are semi-cylindrical in cross-section.

27. An electrical connector assembly, comprising:

a pair of modular subassemblies each including an outer housing having a mating face with a mating portion for mating with a complementary mating connector in a mating direction, and a side face with a cavity;

a terminal module having a dielectric inner housing positioned in said cavity, and a plurality of terminals mounted on the inner housing with contact portions at said mating portion for engaging appropriate contacts of the complementary mating connector; and complementary interengaging retention means between the outer and inner housings of each modular subassembly for retaining the terminal module on the outer housing with the inner housing in the cavity of the outer housing;

whereby the outer housings of the modular subassemblies can be joined at the side faces thereof to conceal the terminal modules therewithin.

28. The electrical connector assembly of claim 27 wherein the complementary interengaging retention means includes upper and lower shoulders in said cavity which engage upper and lower edges respectively of the inner housing.

29. The electrical connector assembly of claim 27 wherein said mating portion at the mating face of the outer housing of each modular subassembly comprises a receptacle for receiving at least one mating plug connector.

30. The electrical connector assembly of claim 29 wherein the contact portions of said terminals project into said receptacle.

31. The electrical connector assembly of claim 30 wherein the mating face of the outer housing of at least one of the modular subassemblies includes a plurality of said mating portions, along with a corresponding plurality of said terminal modules in plural cavities in the side face of the outer housing of the at least one modular subassembly.

32. The electrical connector assembly of claim 30 wherein the outer housing of each modular subassembly includes a plurality of mating portions in the mating face thereof and a plurality of cavities in the side face thereof, along with a corresponding plurality of said terminal modules in said cavities.

33. The electrical connector assembly of claim 27, including complementary interengaging latch means between the outer housings of the pair of modular subassemblies at the side faces of the outer housings to hold the subassemblies together.

34. The electrical connector assembly of claim 33 wherein said complementary interengaging latch means include at least one latch arm on the outer housing of at least one of the modular subassemblies engageable with a latch member on the outer housing of the other subassembly.

35. The electrical connector assembly of claim 34 wherein the outer housings of said pair of modular subassemblies are hermaphroditic, with one of said latch arms and one of said latch members on each outer housing.

36. The electrical connector assembly of claim 27, including complementary interengaging locating means between the outer housings of said pair of modular subassemblies.

37. The electrical connector assembly of claim 36 wherein said complementary interengaging locating means include at least one locating post projecting from the side face of the outer housing of at least one of the modular subassemblies insertable into a locating hole in the side face of the outer housing of the other subassembly generally perpendicular to said plug insertion direction.

38. The electrical connector assembly of claim 37 wherein the outer housings of said pair of modular subassemblies are hermaphroditic, with one of said locating posts and one of said locating holes on each outer housing.

39. The electrical connector assembly of claim 38 wherein the locating post and locating hole of each outer housing are immediately adjacent each other and are semi-cylindrical in cross-section.

* * * * *